US008961233B2

(12) United States Patent
Lai et al.

(10) Patent No.: US 8,961,233 B2
(45) Date of Patent: Feb. 24, 2015

(54) ELECTRICAL CONNECTOR

(71) Applicant: Concraft Holding Co., Ltd., Grand Cayman (KY)

(72) Inventors: Shih-Chia Lai, Grand Cayman (KY); Yi-Hui Hsiao, Grand Cayman (KY)

(73) Assignee: Concraft Holding Co., Ltd., Grand Cayman (KY)

( * ) Notice: Subject to any disclaimer, the term of this patent is extended or adjusted under 35 U.S.C. 154(b) by 30 days.

(21) Appl. No.: 13/905,843

(22) Filed: May 30, 2013

(65) Prior Publication Data

US 2014/0357129 A1 Dec. 4, 2014

(51) Int. Cl.
*H01R 24/00* (2011.01)
*H01R 13/516* (2006.01)

(52) U.S. Cl.
CPC ..... *H01R 13/516* (2013.01)
USPC ..... 439/626

(58) Field of Classification Search
CPC ..... H01R 13/447; H01R 13/514
USPC ..... 439/626, 41, 135, 940
See application file for complete search history.

(56) References Cited

U.S. PATENT DOCUMENTS 4,845,592 A * 7/1989 Himes et al. ..... 361/775
5,853,303 A * 12/1998 Brunker et al. ..... 439/637
6,830,457 B1 * 12/2004 Korsunsky et al. ..... 439/41
8,529,275 B2 * 9/2013 Kagotani ..... 439/41

* cited by examiner

*Primary Examiner* — Phuongchi T Nguyen
(74) *Attorney, Agent, or Firm* — Rabin & Berdo, P.C.

(57) ABSTRACT

An electrical connector is provided to assembled on a circuit board for inserting a connecting member, and includes an insulating body having a cavity, a plurality of first terminals received in the insulating body for connecting with the connecting member, a cap body covered on the insulating body and a set of positioning mechanisms provided for fixing the cap body on the insulating body. Each positioning mechanism has first positioning portions and second positioning portions, so that the first positioning portions are buckled with the second positioning portions. The first positioning portions and the second positioning portions are assembled on the insulating body and the cap body respectively. Under this arrangement, the cap body is securely fixed on the insulating body via the positioning mechanisms, so that the first terminals are not detached from the insulating body.

9 Claims, 5 Drawing Sheets

8-8

9-9

ELECTRICAL CONNECTOR

BACKGROUND OF THE INVENTION

1. Technical Field

The present invention relates to an electrical connector, and particularly to an electrical connector in which the structures of the terminals are simplified and meet the requirements of high speed transmission.

2. Related Art

In U.S. Pat. No. 6,926,565, as shown in FIGS. 1-2, a conventional electrical connector A is disclosed, and has terminals B which are capable of transmitting information signals with high speed. In order to meet the requirements of high speed transmission, the terminals B are designated to align in series, wherein a positioning portion B1 is formed on the middle part of each terminal B. Each positioning portion B1 is approximately formed as U-shaped so as to form a notch B2.

The conventional electrical connector A can transmit information signals with high speed; however, as shown in FIG. 2, the terminals B are deformed easily because of the notches B2 formed on the middle part of the positioning portion B1 upon assembling the terminals B to the conventional electrical connector A. In fact, the notches B2 not only reduce the mechanical strength of the terminals B but also complicate the structure of the terminals B.

Particularly, besides meeting the requirements of high speed transmission, electrical connectors are designated to meet the requirements for reduced thickness. Therefore, in order to meet the requirements for reduced thickness, the height of each terminal B of the conventional electrical connector A is limited, and so is the height of edges of the notch B2. Under this arrangement, upon assembling the terminals B on the conventional electrical connector A, the terminals B are deformed easily, so that the two ends of the notch B2 contact each other. Consequently, the transmission speed is reduced.

Additionally, when the terminals B are deformed, weld legs B3 of the terminals B are also tilted, so that the flatness of the weld legs B3 is not uniform after the terminals B are assembled on the conventional electrical connector A. Based on this, conditions of solder empty or non-wetting of the weld legs B3 occur. Additionally, besides the weld legs B3 are tilted easily, contacting arms B4 of the terminals B are also deformed and tilted easily, so that the contacting arms B4 cannot connect electrically to a connecting member in an efficient manner. Eventually, an electrical failure condition occurs.

SUMMARY

In view of this, the present invention proposes an electrical connector is provided for disposing on a circuit board and inserting a connecting member. The electrical connector has an insulating body, a plurality of first terminals, a cap body and a set of positioning mechanisms. The insulating body has a top portion, a bottom portion, a rear wall portion and two side wall portions which define a cavity with the top portion, the bottom portion, and the rear wall portion. The first terminals are received in the insulating body. The cap body is covered on the insulating body and has an upper plate, a rear plate and two side plates. The upper plate is covered on the upper portion of the insulating body. The rear plate is covered on the rear wall portion of the insulating body. The two side plates are covered on the two side wall portions of the insulating body respectively. The positioning mechanisms are provided to fasten the cap body on the insulating body. Each positioning mechanism has two first positioning portions and two second positioning portions buckled with each other respectively. The two first positioning portions are assembled on the two side wall portions of the insulating body respectively. The two second positioning portions are assembled on the two side plates of the cap body respectively.

Based on this, the cap body is securely fixed on the insulating body via the positioning mechanisms, so that the first terminals are not detached from the insulating body. As a result, not only the simplification of the first terminals is achieved, the electrical connector of the present invention but also meets the requirements of high speed transmission and the requirements for reduced thickness.

The two first positioning portions are two extruded blocks protruded from the two side wall portions of the insulating body respectively. The two second positioning portions are two buckling grooves recessed on the two side plates of the cap body respectively. Therefore, via the buckling between the buckling grooves and the extruded blocks, the first positioning portions and the second positioning portions are buckled with each other correspondingly, so that the cap body is fixed on the insulating body.

The electrical connector further has a set of limiting mechanisms. Each limiting mechanism has two first limiting portions and two second limiting portions engaged with each other respectively. The two first limiting portions are assembled on two sides of the rear wall portion of the insulating body respectively. The two second limiting portions are assembled on two sides of the rear plate of the cap body respectively. The two first limiting portions are two limiting grooves recessed on the two sides of the rear wall portion of the insulating body respectively. The two second limiting portions are two limiting blocks extruded from the two sides of the rear plate of the cap body respectively. Therefore, via the engagement between the limiting blocks and the limiting grooves, the cap body is limited on the insulating body.

The insulating body further has a plurality of receiving grooves for receiving the first terminals, and each receiving groove is extended on the top portion and the rear wall portion of the insulating body.

A plurality of positioning blocks is extruded from the rear wall portion of the insulating body. An engaging groove is formed between each positioning block and the rear wall portion. The rear plate of the cap body is partially engaged in the engaging groove.

The top portion of the insulating body has at least one engaging protrusion extruded thereon. An engaging indentation is formed on the upper plate of the cap body for engaging with the engaging protrusion.

The electrical connector of the present invention has a plurality of second terminals. Parts of the first terminals are exposed from the upper side of the cavity of the insulating body. Parts of the second terminals are exposed from the bottom side of the cavity of the insulating body.

The detailed features and advantages of the present invention are described below in great detail through the following embodiments, the content of the detailed description is sufficient for those skilled in the art to understand the technical content of the present invention and to implement the present invention there accordingly. Based upon the content of the specification, the claims, and the drawings, those skilled in the art can easily understand the relevant objectives and advantages of the present invention.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
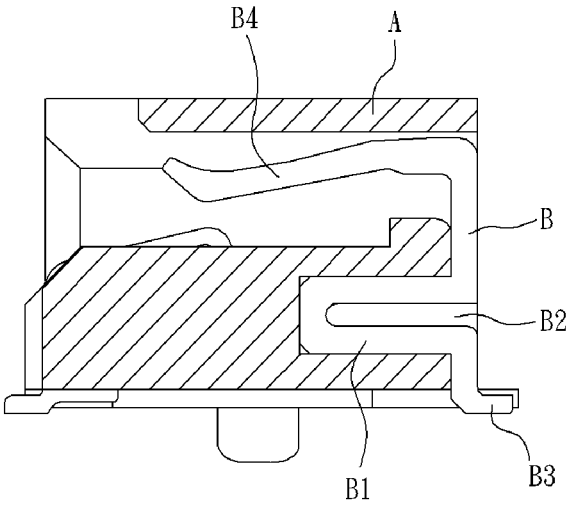
FIG. 1 (PRIOR ART)
FIG. 1 is a cross-sectional view of a conventional electrical connector.
Figure 2:
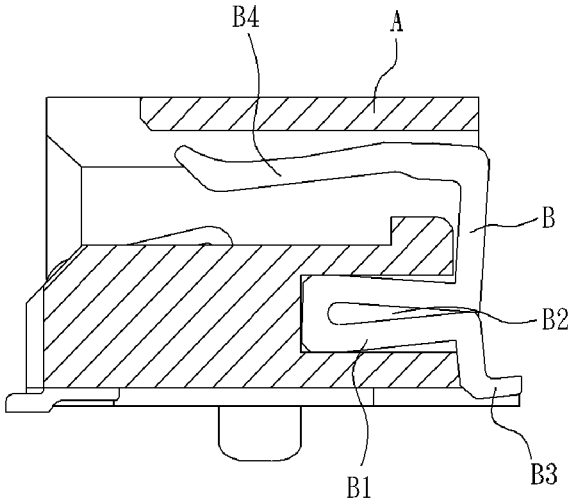
FIG. 2 (PRIOR ART)
FIG. 2 is a cross-sectional view of a deformed conventional electrical connector.
Figure 3:
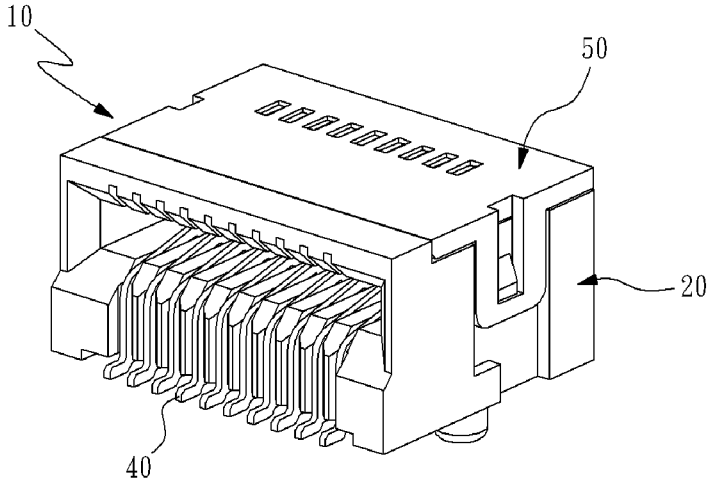
FIG. 3 is a perspective view of an electrical connector of the present invention.
Figure 4:
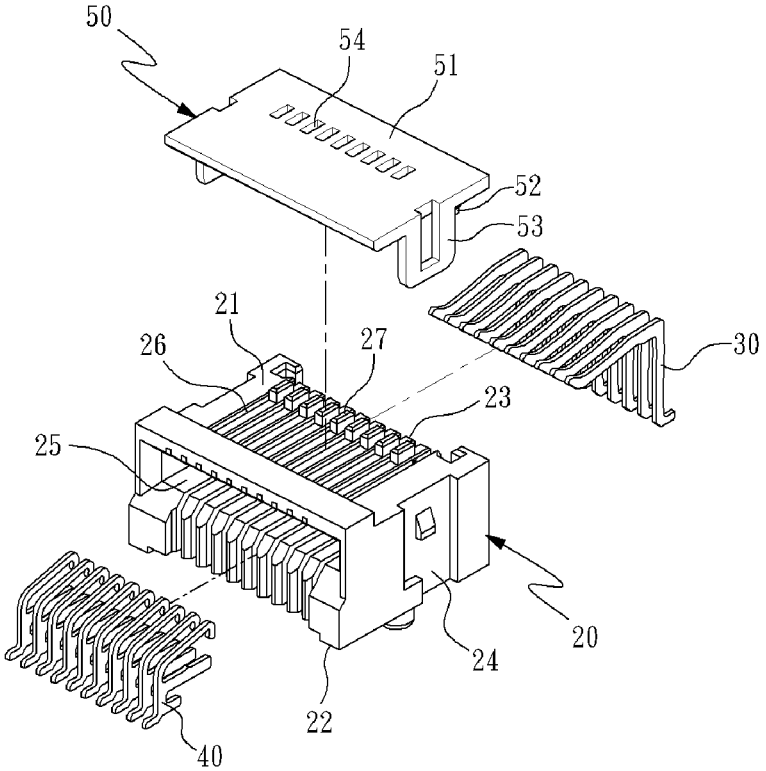
FIG. 4 is a first exploded view of the electrical connector of the present invention.

As shown in FIGS. 3 and 4, an electrical connector 10 of the present invention is provided, which is mainly disposed on a circuit board for inserting a connecting member. The electrical connector 10 has an insulating body 20, a plurality of first terminals 30, a plurality of second terminals 40 and a cap body 50.

The insulating body 20 has a top portion 21, a bottom portion 22, a rear wall portion 23 and two side wall portions 24 which define a cavity 25 with the top portion 21, the bottom portion 22 and the rear wall portion 23. Moreover, a plurality of receiving grooves 26 is opened and extended on the top portion 21 and the rear wall portion 23 in series. Additionally, the top portion 21 has at least one engaging protrusion 27 extruded thereon.

Each first terminal 30 is approximately as L-shaped and received in the corresponding receiving groove 26 of the insulating body 20, wherein each first terminal 30 is inserted from the rear wall portion 23 of the insulating body 20 toward the cavity 25 of the insulating body 20.

The second terminals 40 are received in the insulating body 20, wherein each second terminal 40 is inserted from the cavity 25 of the insulating body 20 toward the rear wall portion 23 of the insulating body 20.

The cap body 50 is covered on the insulating body 20 and has an upper plate 51, a rear plate 52 and two side plates 53. The upper plate 51 is covered on the upper portion 21 of the insulating body 20. The rear plate 52 is covered on an outer side of the rear wall portion 23 of the insulating body 20. The two side plates 53 are covered on the two side wall portions 24 of the insulating body20 respectively. An engaging indentation 54 is formed on the upper plate 51 and corresponds to the engaging protrusion 27 of the insulating body 20.

Figure 5:
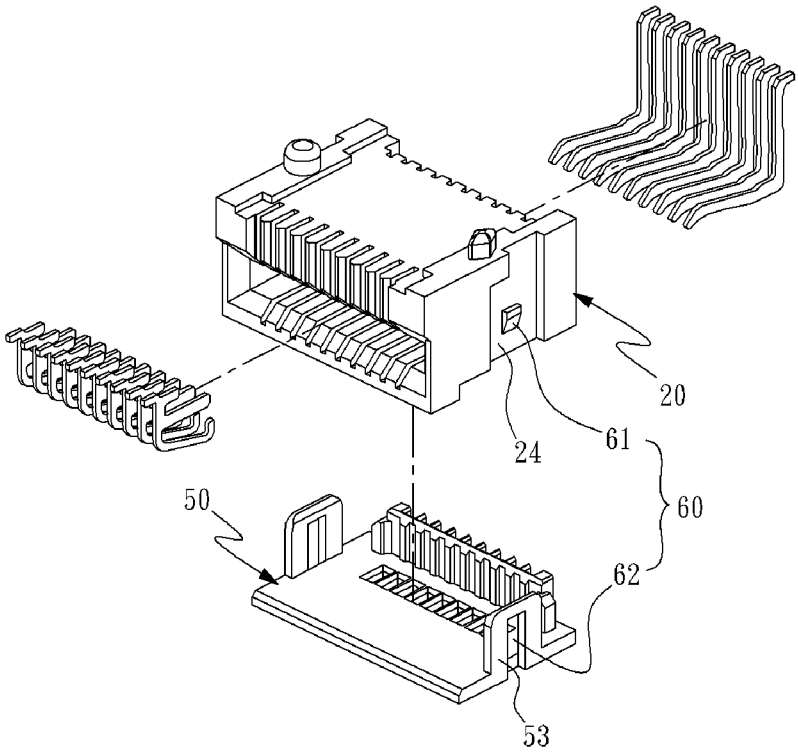
FIG. 5 is a second exploded view of the electrical connector of the present invention.
Figure 6:
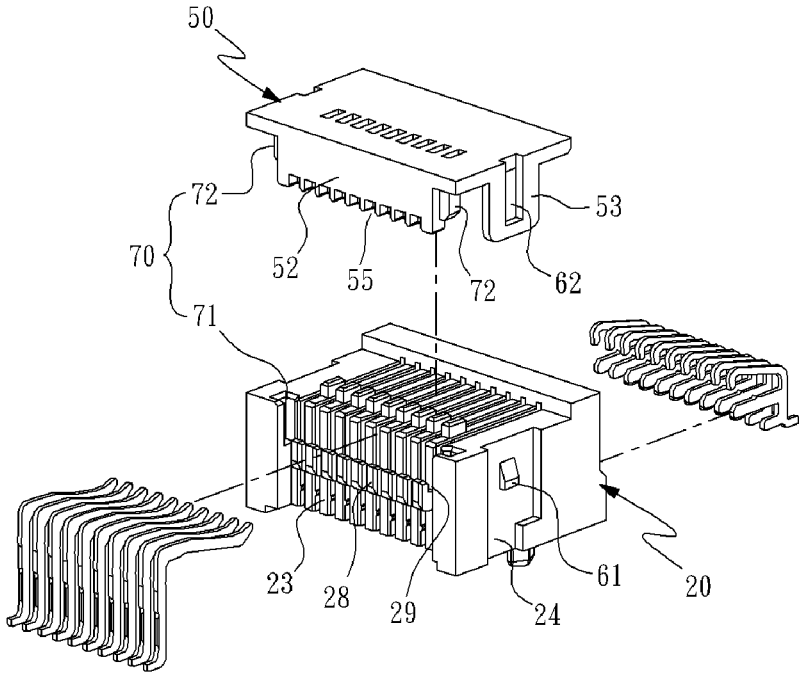
FIG. 6 is a third exploded view of the electrical connector of the present invention.

Please refer to FIGS. 5 and 6, in which a set of positioning mechanisms 60 and a set of limiting mechanisms 70 are provided for fastening and securing the insulating body 20 with the cap body 50.

Each positioning mechanism 60 has two first positioning portions 61 and two second positioning portions 62 buckled with each other respectively. In this embodiment, the two first positioning portions 61 are substantially two extruded blocks protruded from the two side wall portions 24 of the insulating body 20 respectively. The two second positioning portions 62 are substantially two buckling grooves recessed on the two side plates 53 of the cap body 50 respectively.

Each limiting mechanism 70 has two first limiting portions 71 and two second limiting portions 72 engaged with each other respectively. In this embodiment, the two first limiting portions 71 are substantially two limiting grooves recessed on two sides of the rear wall portion 23 of the insulating body 20 respectively. The two second limiting portions 72 are substantially two limiting blocks extruded from two sides of the rear plate 52 of the cap body 50 respectively.

Based on this, upon assembling the cap body 50 on the insulating body 20, the two second limiting portions 72 located on the two sides of the rear plate 52 are inserted into the two first limiting portions 71 located on the two sides of the rear wall portion 23 firstly, so that the cap body 50 is guided to assemble on the insulating body 20 in a top-to-down manner; and then, the two side plates 53 of the cap body 50 are further covered on the two side wall portions 24 of the insulating body 20, so that the two side wall portions 24 are buckled with the two side plates 53 respectively because of the buckling between the first positioning portions 61 and the second positioning portions 62; as a result, the cap body 50 is securely fixed on the insulating body 20.

Additionally, at least one positioning block 28 is extruded from the outer side of the rear wall portion 23 of the insulating body 20. An engaging groove 29 is formed between each positioning block 28 and the rear wall portion 23. Under this arrangement, a bottom end 55 of the rear plate 52 of the cap body 50 is engaged in the engaging groove 29.

Figure 7:
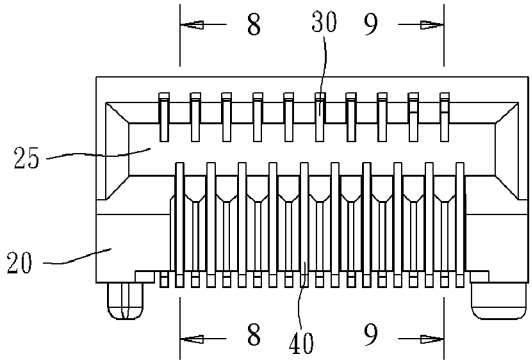
FIG. 7 is a planar schematic view of the electrical connector of the present invention.
Figure 8:
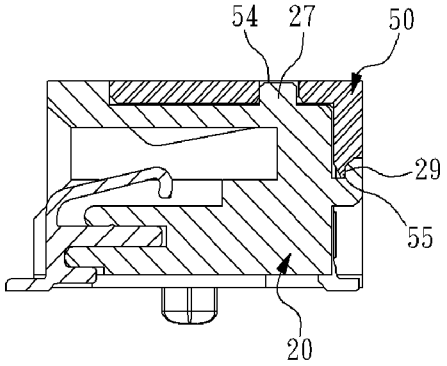
FIG. 8 is a cross-sectional view along line 8-8 shown in FIG. 7.
Figure 9:
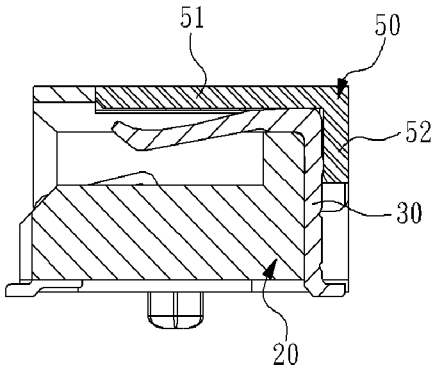
FIG. 9 is a cross-sectional view along line 9-9 shown in FIG. 7.

Please refer to FIGS. 7-9, in which parts of the first terminals 30 are exposed from the upper side of the cavity 25 of the insulating body 20, and parts of the second terminals 40 are exposed from the bottom side of the cavity 25 of the insulating body 20. Furthermore, the first terminals 30 and the second terminals 40 are aligned with each other in a staggered and spacing manner.

When the cap body 50 is covered on the insulating body 20, the cap body 50 is engaged with the engaging groove 29 via the bottom end 55 of the rear plate 52, and the engaging protrusion 27 of the insulating body 20 is engaged with the engaging indentation 54 of the cap body 50. Under this arrangement, when the first terminals 30 are inserted into the insulating body 20, the upper plate 51 of the cap body 50 is disposed above the first terminals 30, and the rear plate 52 of the cap body 50 is disposed behind the first terminals 50. Therefore, the first terminals 30 are positioned and fastened by the cap body 50 and the insulating body 20, so that the first terminals 30 are not detached from the insulating body 20.

In other words, in the present invention, since no further structure is defined on the first terminals 30 for engaging with the insulating body 20, the structures of the first terminals 30 are rather simpler as compared to conventional. In addition, the first terminals 30 are securely positioned within the insulating body 20 because of the engagement between the cap body 50 and the insulating body 20. Additionally, the rear sides and the upper sides of the first terminals 30 are blocked by the cap body 50, so that the first terminals 30 will not detached from the insulating body 20 along the inserting direction of the first terminals 30. Furthermore, because the cap body 50 is covered on the upper sides of the first terminals 30, the weld leg of each first terminal 30 retains a better flatness.

Moreover, besides simplifying the structures of the first terminals 30 and meeting the requirements of high speed transmission, the electrical connector 10 of the present invention efficiently reduces heights of the first terminals 30, so that the electrical connector 10 of the present invention meets the requirements for reduced thickness.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical connector, provided to assemble on a circuit board for inserting a connecting member, comprising:

an insulating body, having a top portion, a bottom portion, a rear wall portion, and two side wall portions which define a cavity with the top portion, the bottom portion, and the rear wall portion, the cavity being provided for inserting the connecting member;

a plurality of first terminals, received in the insulating body and partially protruded out of the cavity of the insulating body;

a cap body, covered on the insulating body, having an upper plate, a rear plate and two side plates, the upper plate being covered on the upper portion of the insulating body, the rear plate being covered on the rear wall portion of the insulating body, the two side plates being covered on the two side wall portions of the insulating body respectively; and a set of positioning mechanisms, provided to fasten the cap body on the insulating body, each positioning mechanism comprising two first positioning portions and two second positioning portions buckled with each other respectively, the two first positioning portions being assembled on the two side wall portions of the insulating body respectively, the two second positioning portions being assembled on the two side plates of the cap body respectively.

2. The electrical connector according to claim 1, wherein the two first positioning portions are two extruded blocks protruded from the two side wall portions of the insulating body respectively, the two second positioning portions are two buckling grooves recessed on the two side plates of the cap body respectively.

3. The electrical connector according to claim 1, wherein the insulating body comprises a plurality of receiving grooves for receiving the first terminals.

4. The electrical connector according to claim 3, wherein each receiving groove is extended on the top portion and the rear wall portion of the insulating body.

5. The electrical connector according to claim 1, wherein a plurality of positioning blocks is extruded from the rear wall portion of the insulating body, an engaging groove is formed between each positioning block and the rear wall portion, the rear plate of the cap body is partially engaged in the engaging groove.

6. The electrical connector according to claim 1, wherein the top portion of the insulating body has at least one engaging protrusion extruded thereon, an engaging indentation is formed on the upper plate of the cap body for engaging with the engaging protrusion.

7. The electrical connector according to claim 1, wherein a plurality of second terminals is provided, parts of the first terminals are exposed from the upper side of the cavity of the insulating body, and parts of the second terminals are exposed from the bottom side of the cavity of the insulating body.

8. The electrical connector according to claim 1, wherein a set of limiting mechanisms are provided, each limiting mechanism comprises two first limiting portions and two second limiting portions engaged with each other respectively, the two first limiting portions are assembled on two sides of the rear wall portion of the insulating body respectively, the two second limiting portions are assembled on two sides of the rear plate of the cap body respectively.

9. The electrical connector according to claim 8, wherein the two first limiting portions are two limiting grooves recessed on the two sides of the rear wall portion of the insulating body respectively, the two second limiting portions are two limiting blocks extruded from the two sides of the rear plate of the cap body respectively.

* * * * *